US005807476A

United States Patent [19]

Collins et al.

[11] Patent Number: 5,807,476

[45] Date of Patent: Sep. 15, 1998

[54] METHOD OF REMOVING SULFUR COMPOUNDS FROM SOUR CRUDE OIL AND SOUR NATURAL GAS

[75] Inventors: Bevan C. Collins, Bartlesville, Okla.; Pat A. Mestetsky, St. Charles; Nicholas J. Savaiano, Westmont, both of Ill.

[73] Assignee: United Laboratories, Inc., St. Charles, Ill.

[21] Appl. No.: 541,611

[22] Filed: Oct. 10, 1995

[51] Int. Cl.[6] ..... C10G 29/20

[52] U.S. Cl. ..... 208/236; 208/47; 208/348; 44/301; 585/950

[58] Field of Search ..... 208/47, 236, 348; 44/301; 585/950

[56] References Cited

U.S. PATENT DOCUMENTS

| | | | |
|---|---|---|---|
| 3,457,168 | 7/1969 | Malmberg | 210/21 |
| 3,740,315 | 6/1973 | Li et al. | 195/2 |
| 4,415,662 | 11/1983 | Thirumalachar et al. | 435/176 |
| 4,539,100 | 9/1985 | Ronden | 208/188 |
| 4,628,836 | 12/1986 | Littmann | 208/47 |
| 4,739,041 | 4/1988 | Morrow | 166/275 |
| 4,821,757 | 4/1989 | Hayer et al. | 137/13 |
| 4,886,519 | 12/1989 | Hayes et al. | 44/51 |
| 5,084,160 | 1/1992 | Stewart et al. | 208/428 |
| 5,358,870 | 10/1994 | Monticello et al. | 435/482 |
| 5,385,842 | 1/1995 | Weimer et al. | 435/262 |
| 5,389,156 | 2/1995 | Mehta et al. | 134/10 |
| 5,529,930 | 6/1996 | Monlicello et al. | 435/281 |

FOREIGN PATENT DOCUMENTS

| | | | |
|---|---|---|---|
| 9305187 | 3/1993 | WIPO | C12J 13/00 |

OTHER PUBLICATIONS

Product Bulletin, ZYME–Flow Refinery Super Concentrated Enzyme–Based Grease Pre–Digester United 657.

*Primary Examiner*—Helane Myers

[57] ABSTRACT

A method of removing hazardous sulfur compounds, such as hydrogen sulfide and sulfur dioxide, from sour crude oil and sour natural gas. An aqueous composition of an amine oxide surfactant, and preferably a mixture of an amine oxide surfactant and enzymes, is mixed with the sour crude oil or sour natural gas. The surfactant reacts with the hazardous sulfur compounds to eliminate the evolution of the compounds from the crude oil or gas and the enzymes act to catalyze the reaction.

4 Claims, 2 Drawing Sheets

METHOD OF REMOVING SULFUR COMPOUNDS FROM SOUR CRUDE OIL AND SOUR NATURAL GAS

BACKGROUND OF THE INVENTION

Natural fossil fuels, such as crude oil and natural gas, that contain a substantial concentration of sulfur compounds, such as hydrogen sulfide, sulfur dioxide, and mercaptans are referred to as "sour". The hazardous sulfur compounds are evolved from the sour crude oil or sour natural gas over an extended period of time, and the evolution of these compounds produces a serious environmental and safety problem. Hydrogen sulfide is regulated under 40 C.F.R. §65, while sulfur dioxide is regulated under the Clean Air Act 40 C.F.R. §80.

Not only does the evolution of the sulfide compounds, such as hydrogen sulfide and sulfur dioxide, from sour crude oil and natural gas create a serious environmental and safety problem, but these compounds attack the metal components of the oil well, as well as pipelines and storage tanks, causing brittleness and/or corrosion of the metal components. With a well that is delivering sour crude oil, the service life for a well casing is generally less than five years, while the actuating rod and tube within the well casing may only have a service life of several months. The replacement of these components, such as the actuating rod, tubing and other mechanical equipment, not only results in a substantial expenditure for the replacement parts, but also results in considerable down time for the well.

In some instances sour crude oil or sour natural gas may be treated by chemical and/or mechanical processing, in an attempt to reduce the concentration of the hazardous sulfide compounds to an acceptable level. However, such processing requires a substantial capital expenditure for the processing equipment, and it has been found that it is often economically unfeasible to reduce the concentration of the hazardous compounds to an acceptable level. Thus, sour crude oil, even after treatment to reduce the content of the sulfur compounds will be unacceptable for many usages, with the result that the crude oil will be sold for a lesser price. In other situations, where the sour crude oil or natural gas has an extremely high level of sulfur compounds, it is unfeasible to utilize the oil or gas, with the result that the well is merely plugged and abandoned.

Certain aqueous industrial and household cleaners, as well as laundry detergents, contain a mixture of enzymes and surfactants. The enzymes can include one or more of a combination of proteases, amylases, lipases, cellulases, and pectinases and serve to attack or degrade organics such as grease, oil, or other soil, while the surfactant acts to disperse the degraded particles in the aqueous phase. Surfactants contain both hydrophilic and oleophilic groups, and according to the dispersion mechanism, an oleophilic group on the surfactant will attach to a particle of the oil, grease, or other soil, and pull it into dispersion by the attraction of the surfactant's hydrophilic group, for the water with which it is added. The dispersion is maintained by the action of the surfactant's hydrophilic groups. The hydrophilic groups on different surfactant molecules repel each other which necessarily results in the repulsion between the particles of oil, grease, and soil.

One type of industrial use of cleaning compositions of this type containing enzymes and a surfactant is to remove soiled lubricant from industrial machinery. In this manner of treatment, the aqueous cleaning composition containing a surfactant and enzymes is impinged on the surface to be treated through high pressure hoses or jets, and the residual wash water contains the soiled lubricant consisting of oil, grease, dirt, metal chippings, and the like, which are dispersed throughout the aqueous cleaning composition.

It has also been recognized, as disclosed in WO 93/051287, that the addition of an amine oxide surfactant and enzymes to oily waste water will result in the separation of an oil phase from the water phase when the waste water is permitted to stand in a quiescent state.

SUMMARY OF THE INVENTION

The invention is directed to a method of removing hazardous sulfur compounds from sour fossil fuels, such as crude oil and natural gas through use of a treating composition containing an amine oxide surfactant, and preferably, the combination of an amine oxide surfactant and enzymes.

In one aspect of the invention, the treating composition is added to the sour crude oil in a storage tank or vessel, and preferably mixed with the oil by pumping the oil from the lower portion of the tank and recirculating it to the upper portion.

In a second embodiment of the invention, the treating composition is added in-stream to the sour crude oil at the wellhead, either by injecting the treating composition into the pipeline through which the oil is flowing from the well, or by feeding or dripping the treating composition into the casing of the well, in which case, the treating composition will flow downwardly along the inner surface of the casing and mix with the oil in the well and the mixture will be drawn upwardly through the central tube to the wellhead.

As a further aspect of the invention, sour natural gas can be treated by flowing the gas through a treating vessel in countercurrent relation to a spray of the treating solution.

The amount of the treating composition added to the sour crude oil or natural gas is not critical and depends on the level of concentration of the sulfur compounds. In a typical application, the treating composition may contain from 0.9 to 12 parts by weight of the surfactant to one part by weight of enzymes. The treating composition can be added to the sour crude oil or natural gas in a ratio of about 1 part by weight of the treating composition to 1 to 15000 parts of the crude oil or natural gas.

It is believed that the surfactant reacts with the sulfur compounds and the reaction product is bound in the water phase, thereby preventing evolution of the compounds from the crude oil or natural gas. It is further believed that the enzymes, when utilized, act as a catalyst to increase the reaction rate. The incorporation of the treating composition with the sour crude oil or sour natural gas does not have any deleterious effect on the oil or gas, and the treating composition appears to selectively react with the sulfur compounds.

By reducing the content of the sulfur compounds in the sour crude oil or sour natural gas, the evolution of these compounds from the oil or gas is reduced or eliminated, thus reducing the need for expensive pollution control equipment, which would normally be necessary in order to prevent the hazardous compounds from entering the atmosphere.

The elimination of the sulfur compounds from the sour fossil fuel also prevents the embrittlement and/or corrosion of metal components of the well, as well as pipelines, storage tanks, and the like, thus greatly increasing the service life of these components.

Other objects and advantages will appear in the course of the following description.

DESCRIPTION OF THE ILLUSTRATED EMBODIMENT

Certain crude oils having a high level of sulfur compounds, particularly dissolved hydrogen sulfide, are referred to as "sour" crude oil. Similarly, certain natural gas as delivered to the wellhead may also have a high concentration of sulfur compounds and is referred to as "sour" natural gas. These sulfur compounds are evolved from the sour crude oil or sour natural gas over a substantial time period, and present a serious pollution and safety problem.

In accordance with the invention, the sour crude oil or sour natural gas is treated with an aqueous composition, either in liquid or vaporized form, containing an amine oxide surfactant and preferably the combination of an amine oxide surfactant and enzymes. The surfactant to be used in the invention is a water soluble, amphoteric type with an HLB (hydrophiliclipophilic balance) of 8 to 14. More particularly, the surfactant can have the following formula:

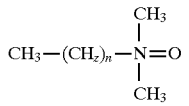

where n is 6 to 20. Specific examples of a surfactant covered by the above formula are lauryl dimethylamine oxide, stearyl dimethylamine oxide, myristyl dimethyl amine oxide, and mixtures thereof. The preferred surfactant of this group is lauryl dimethylamine oxide.

The enzymes that can be incorporated with the surfactant are selected from the group consisting of proteases, amylases, lipases, cellulases, pectinases, and mixtures thereof.

Preferably, the enzyme is selected from the group consisting of bacterial protease from *Bacillus subtilis*, amylase from *Bacillus subtilis*, lipase from *Aspergillus niger*, cellulase from *Aspergillus niger*, pectinase from *Aspergillus niger*, and mixtures thereof. More preferably, the method of the present invention utilizes an enzyme mixture of protease from *Bacillus subtilis*, amylase from *Bacillus subtilis*, lipase from *Aspergillus niger*, cellulase from *Aspergillus niger*, and pectinase from *Aspergillus niger*. A mixture of enzymes of this type is sold by Applied Biochemists, Inc., Milwaukee, Wis. under the trademark "AMERZYME-A-100".

More particularly, "AMERZYME-A-100" contains 150 FCC/gm lipase, 320 PC/gm protease, 1350 BAU/gm bacterial amylase, and 320 C-ASE/gm cellulase, all of which are fungal in origin.

The amount of the surfactant to be incorporated with the sour crude oil or sour natural gas is not critical, and depends largely on the concentration of the sulfur compounds, such as hydrogen sulfide and sulfur dioxide. In practice, the treating composition containing the surfactant can be used in a weight ratio of 1 part of the composition to 1 to 15,000 parts of the sour crude oil, based on 100% active ingredients. The enzymes can be used in a weight ratio of about 0.9 to 12 parts of surfactant to one part of enzyme, based on 100% active ingredients.

Figure 1:
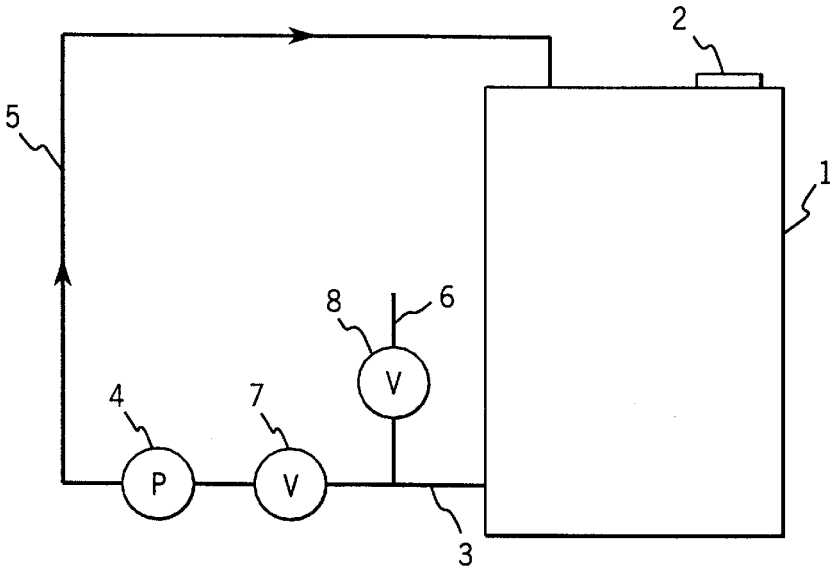
FIG. 1 is a schematic representation illustrating a first manner of carrying out the invention in the treatment of sour crude oil.

FIG. 1 schematically shows a manner of applying the treating composition to the sour crude oil. The sour crude oil is contained within a tank or vessel 1, having an upper removable hatch 2. An outlet line 3, is connected to the lower portion of tank 1 and is connected to the suction side of a pump 4, while a discharge line 5 from pump 4 is connected to the upper end of tank 1. A supply line 6, for purposes of sales, is connected to line 3 and valves 7 and 8 are mounted in lines 3 and 6, respectively.

With this construction, the treating composition is fed into tank 1 through the open hatch 2. Valve 7 is open, while valve 8 is closed, and pump 4 is operated causing the oil to be drawn from tank 1 from the outlet line 3 and recirculated through line 5 to the upper end of the tank. This circulation will cause intimate mixing of the treating composition with the sour crude oil. In practice, the pumping can continue for a time sufficient to replace three volumes of the tank, and preferably about five volumes.

During this circulation, the surfactant will react with the dissolved sulfur compounds in the crude oil, and it is believed that the enzymes will catalyze the reaction. The reaction products are believed to be bound in the water phase, thus minimizing or eliminating the evolution of the hazardous sulfur compounds from the sour crude oil.

While circulation of the crude oil containing the treating composition is preferred in order to obtain intimate mixing, in other situations the treating composition may merely be fed into the body of crude oil and over a period of time dispersion of the composition throughout the oil will occur.

Figure 2:
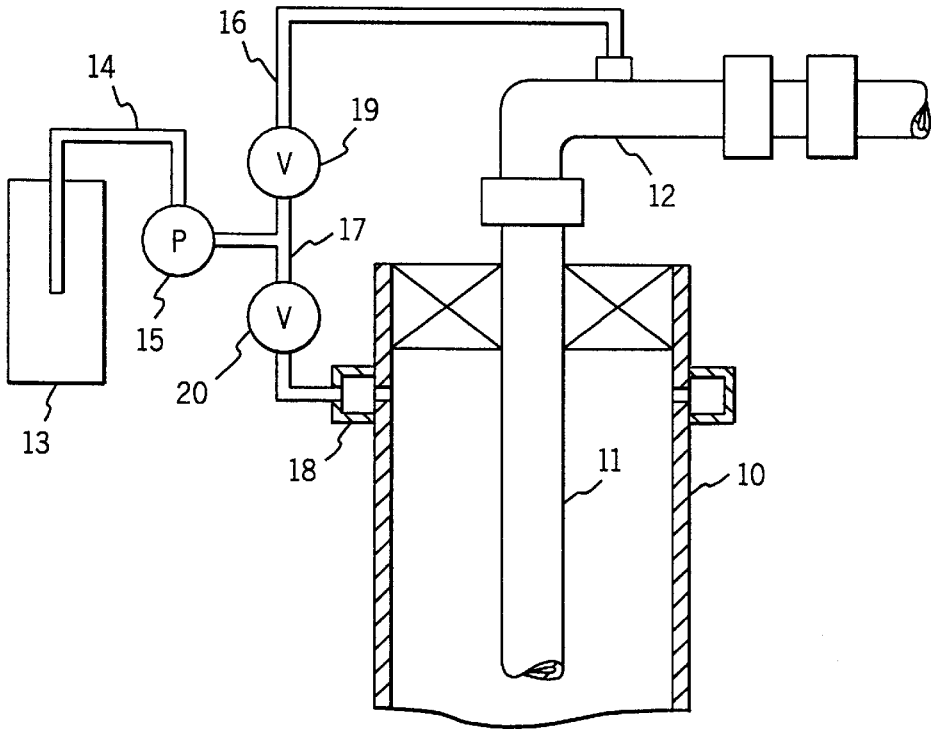
FIG. 2 is a schematic drawing illustrating a second embodiment of the invention.

FIG. 2 represents a second modified form of the invention, in which the treating composition is added to the sour crude oil at the wellhead. FIG. 2 illustrates a typical free flowing well having an outer casing 10 and a central concentric tube 11, which is sealed to the casing and extends upwardly through the wellhead and is connected to a pipeline 12.

The treating composition is contained within a container or tank 13, and the tank is connected via line 14 to the suction side of a pump 15. The discharge side of pump 15 is connected to lines 16 and 17. Line 16 is connected to pipeline 12, while line 17 is connected to a distribution collar 18 that is mounted on the upper end of the casing 13. Suitable valves 19 and 20 are mounted in lines 16 and 17.

With the construction of FIG. 2, when valve 19 is open and valve 20 is closed, the treating composition will be pumped through line 16 and fed into the sour crude oil flowing within pipeline 12. The circulation of the crude oil in the pipeline will cause intimate mixing of the treating composition with the crude oil. Alternately, valve 19 can be closed and valve 20 open, in which case the treating composition will be fed to the distribution collar 18, where it will be sprayed or dripped through ports or nozzles in casing 10 into the annular space between the casing and tube 11. The composition will flow downwardly along the inner wall of casing 10, as well as along the outer wall of tube 11, and will mix with the crude oil at the bottom of the well. The mixture will then be drawn upwardly through the tube 11 to the wellhead.

As in the case of the first embodiment, the treating composition will react with the sulfur compounds in the sour crude oil, and the reaction products are believed to be bound in the aqueous phase, thus preventing evolution of the hazardous compounds from the crude oil. As the evolution of the compounds, such as hydrogen sulfide, is minimized or eliminated, the process minimizes the necessity of expensive pollution equipment that would normally be required to reduce the hazardous sulfur compounds in the crude oil to an acceptable level.

Further, by eliminating the sulfur-containing compounds in the crude oil, the possibility of these compounds attacking the metal components of the well, the pipeline, or storage tanks is eliminated. Thus, the service life of not only the well components, but the pipeline and storage tanks, are substantially increased.

Figure 3:
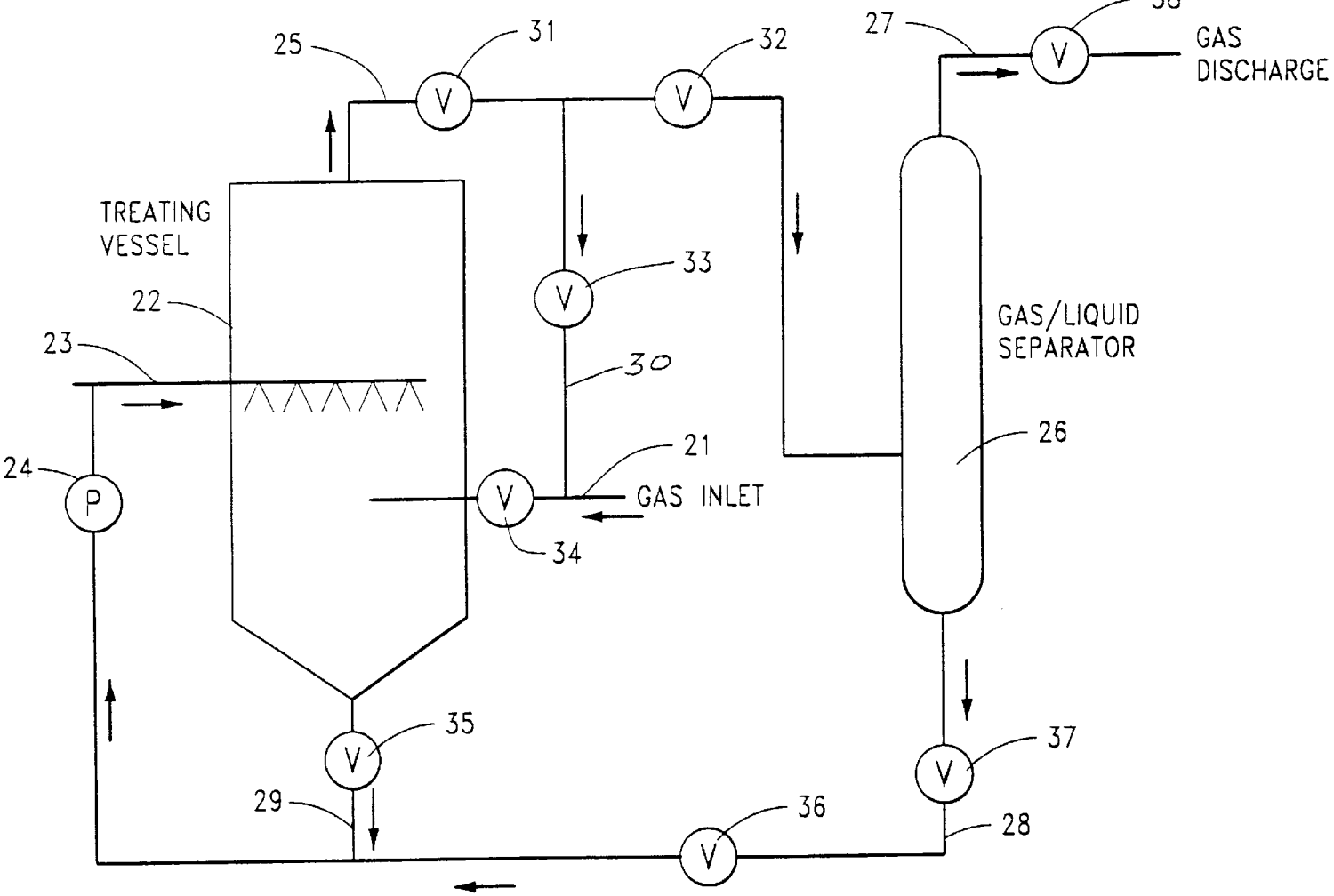
FIG. 3 is a schematic drawing illustrating a further embodiment of the invention utilized for treating sour natural gas.

FIG. 3 schematically illustrates the method of the invention as utilized to remove sulfur compounds from sour natural gas. The sour natural gas flowing in line 21 is introduced into the central portion of a generally vertical treating vessel 22. The aqueous liquid treating composition containing the amine oxide surfactant, and preferably including enzymes, is pumped through line 23 into the upper portion of vessel 22 by pump 24, and the treating composition is sprayed downwardly through a plurality of jets or nozzles in counter current relation to the upward flow of the sour natural gas. Suitable baffles or trays can be incorporated in the treating vessel 22 to increase the contact time between the liquid treating composition and the gas.

As previously described, the surfactant will react with the sulfur compounds in the sour natural gas and is believed that the reaction products will be bound in the water phase. The enzymes, if utilized, act to catalyze the reaction.

The treated natural gas containing water vapor is discharged from the upper end of vessel 22 through line 25, and is introduced into the central portion of a gas liquid separator 26. Separator 26 is a conventional type and serves to separate the natural gas from the water vapor. The treated gas is discharged from the separator through line 27, while the condensed water vapor exits separator 26 through line 28, which is connected to the suction side of pump 24. In addition, liquid treating composition discharged from the lower end of vessel 22 is connected to return line 28 via line 29. Thus, the treating composition being discharged from vessel 22 along with the liquid separated from the gas in separator 26, can be recycled back to the treating vessel through lines 28 and 23.

In addition, a line 30 can be connected between the gas discharge line 25 and the gas inlet line 21, so that if desired, the gas and water vapor being discharged from the treating vessel 22 can be recirculated to the treating vessel as opposed to being discharged to the separator. Suitable valves 31–38 can be incorporated in the system to control the flow of the gas and treating composition.

The method illustrated in FIG. 3 acts to remove the sulfur compounds from a gaseous media, such as sour natural gas, thus eliminating or minimizing the necessity of incorporating expensive pollution control equipment that would normally be required to reduce the sulfur compounds in the natural gas to an acceptable level.

We claim:

1. A method of removing hazardous sulfur compounds from sour fossil fuel, comprising the steps of contacting sour fossil fuel selected from the group consisting of crude oil and natural gas and containing hazardous sulfur compounds with an aqueous composition consisting essentially of water and an amine oxide having the formula:

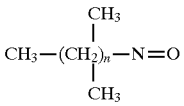

where n is 6 to 20, reacting said amine oxide with said sulfur compounds to produce non-hazardous sulfur-containing reaction products, and binding the reaction products in said water to eliminate the evolution of said hazardous sulfur compounds from said fossil fuel.

2. The method of claim 1, and including the further step of separating the water containing said reaction products from said fossil fuel.

3. A method of removing hazardous sulfur compounds from sour fossil fuel, comprising the steps of contacting sour fossil fuel selected from the group consisting of crude oil and natural gas and containing hazardous sulfur compounds with an aqueous composition consisting essentially of water and an amine oxide selected from the group consisting of lauryl dimethylamine oxide, stearyl dimethylamine oxide, myristyl dimethylamine oxide and mixtures thereof, reacting said amine oxide with said sulfur compounds to produce non-hazardous sulfur-containing reaction products, binding the reaction products in said water to eliminate the evolution of said hazardous sulfur compounds from said fossil fuel, and separating the water containing said reaction products from said fossil fuel.

4. The method of claim 1, and including the step of adding to said aqueous composition enzymes selected from the group consisting of proteases, amylases, lipases, cellulases, pectinases, and mixtures thereof.

* * * * *

UNITED STATES PATENT AND TRADEMARK OFFICE

CERTIFICATE OF CORRECTION

PATENT NO. : 5,807,476
APPLICATION NO. : 08/541611
DATED : September 15, 1998
INVENTOR(S) : Collins et al.

It is certified that error appears in the above-identified patent and that said Letters Patent is hereby corrected as shown below:

Column 3, lines 32 to 36 and column 6, lines 15 to 19, claim 1, cancel the formula, each occurrence, and insert the following formula for each occurrence:

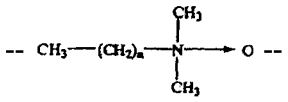

Signed and Sealed this

Thirtieth Day of November, 2010

David J. Kappos

David J. Kappos
*Director of the United States Patent and Trademark Office*